United States Patent [19]

van Zalm

[11] 4,042,515

[45] Aug. 16, 1977

[54] ANHYDROUS DEEP-DRAWING LUBRICANT

[75] Inventor: Fredericus Bastiaan van Zalm, Beverwijk, Netherlands

[73] Assignee: B. V. Beverolfabrieken, Beverwijk, Netherlands

[21] Appl. No.: 605,014

[22] Filed: Aug. 15, 1975

[30] Foreign Application Priority Data

Aug. 16, 1974 Netherlands ..... 7411032

[51] Int. Cl.[2] ..... C10M 1/24; C10M 3/18; C10M 5/12; C10M 7/26

[52] U.S. Cl. ..... 252/56 R; 72/42; 72/46; 252/52 R

[58] Field of Search ..... 72/42, 46; 252/52 R, 252/56 R

[56] References Cited

U.S. PATENT DOCUMENTS

| | | | |
|---|---|---|---|
| 2,124,628 | 7/1938 | Moser | 252/49.5 |
| 2,151,353 | 3/1939 | Montgomery | 252/56 S |
| 2,334,158 | 11/1943 | Fuchs et al. | 252/56 D |
| 3,719,600 | 3/1973 | Bosniak et al. | 252/56 R |
| 3,923,671 | 12/1975 | Knepp | 252/56 R |

*Primary Examiner*—Delbert E. Gantz
*Assistant Examiner*—Irving Vaughn
*Attorney, Agent, or Firm*—Haight & Huard

[57] ABSTRACT

Anhydrous deep-drawing agents having improved wetting and deep-drawing properties are described which can be applied to the surface of a metal to be drawn well in advance of the drawing process. The agent consists essentially of a deep-drawing mineral oil carrier in which is dissolved dimeric carboxylic acids prepared by oligomerization of unsaturated fatty acids having 16 – 26 carbon atoms.

5 Claims, No Drawings

ANHYDROUS DEEP-DRAWING LUBRICANT

This invention relates to an anhydrous deep-drawing agent with improved wetting and deep-drawing properties.

In the cold formation or shaping of metals without metal removal, it is customary to treat the metal with an anhydrous or wet lubricant.

The application of a wet lubricant, that is to say an emulsion of oil and water, has as disadvantages the occurence of corrosion on the metal plate to be treated, whereas at the higher temperatures likely to occur for example in deep-drawing, said emulsions are relatively unstable. Therefore, the preparation of a non-aqueous deep-drawing agent is very desirable.

The use of a mineral oil as a deep-drawing agent is known, while at the same time efforts have been made for improving the formation stimulating properties of such deep-drawing agents by adding additives.

For determining the effect of such additives, a test is mostly made use of by which the influence of the deep-drawing agent on the uniformity of the elongation-distribution in the plate material formed is determined.

For example, it is known from "Mineraloltechnik" No. 11/12, 1969, that by adding fatty acids to mineral oils a considerable improvement of the deep-drawing properties of a thus-prepared agent is obtained.

Although, for example, the addition of oleic acid to a deep-drawing agent already gave a most remarkable improvement of the deep-drawing properties, the wetting properties of a so prepared agent and therefore the durability of the film of the agent, especially when applied on hard to wet metal plates, were not satisfactory.

In a practical test, steel plate was provided with such a deep-drawing agent. Although immmediately after said application the plate was covered with a homogeneous layer of the deep-drawing agent, said layer started to retract already within a few minutes, forming islets (drops) on the plate.

Now, most surprisingly it has been found that by adding to the carrier of a deep-drawing agent dimers and/or trimers of carboxylic acids which optionally contain a monomeric carboxylic acid, excellent deep-drawing properties are obtained as well as a very efficient wetting of the plate treated with such an agent, irrespective of its type.

According to the invention all mineral oils known in themselves as deep-drawing agents may be used as carrier materials. The viscosity of such oils is not critical and will depend on the manner of application.

A suitable carrier is formed, for example, by a mineral oil having a viscosity of 20–40 c S at 50° C.

The dimers and/or trimers of carboxylic acids to be added to the carrier need not be easily soluble therein. The solubility may be promoted by adding an auxiliary agent, for example nonyl alcohol or any other known solution promoting agent.

For the preparation of a deep-drawing agent according to the invention it is not necessary to add to the carrier still other additives, although incorporating small amounts of complementary substances, such as antioxidants etc., is not harmful.

The dimeric and/or trimeric carboxylic acids to be added to the deep-drawing agent of the invention are known in themselves. These carboxylic acids can be prepared by oligomerization of unsaturated fatty acids having for example 16 to 26 carbon atoms, such as oleic acid, ricinoleic acid, linoleic acid, oleostearic acid, etc. A preparation of these dimeric and trimeric fatty acids is described in U.S. Pat. Nos. 2,793,219 and 2,955,122.

In these methods, unsaturated fatty acids are heated in a pressure vessel at a temperature of from 180° to 360° C during a period of about 3 to 10 hours whereafter the product obtained consists substantially of dimeric acids. Very suitable dimeric fatty acids are sold under the trade mark EMPOL by Emery Industries Inc.

The amount of dimeric and/or trimeric fatty acid to be added may be varied within wide limits, it being mainly defined by the solubility of the dimeric and/or trimeric fatty acid in the carrier chosen, by the desired improvement of deep-drawing- and dewetting properties and by the economics of the product to be prepared. An amount found very suitable in practice with which very good practical results have been obtained, as far as the solubility as well as the deep-drawing- and wetting properties and the product economics are concerned, is an amount of from 1 to 15% by weight, calculated on the carrier.

The deep-drawing agents of the invention may be applied to the metal to be treated in various ways. For example, the agent may be applied to the metal by spraying, by application rollers or by immersion in a bath of the agent.

A special advantage of the compositions of the invention is that as a result of their high wetting capacity they may be applied to the metal a long time before the deep-drawing treatment without local disappearance of the deep-drawing agent by the formation of drops. In consequence thereof, it is as a rule no longer necessary that shortly before the deep-drawing treatment an additional deep-drawing agent, for example a paste, be applied, while at the same time the advantage is obtained that the deep-drawing agent may already be applied in the rolling mill.

It is to be noted from U.S. Pat. No. 3,006,849 that the addition of an aliphatic polycarboylic acid to a metal processing oil is known in itself. However, the agents mentioned in said patent specification are aqueous lubricants for machining metals with metal removal whereas besides the polycarboxylic acids still other additives such as alkanol amines are imperative.

The testing of the deep-drawing agents of the invention together with the reference agents was carried out in the manner described by C. C. Veerman in "Deep-Drawing Conference", 24/25 April 1972, pages 88–89; C. C. Veerman "7th Biennal Congress of the International Deep Drawing Research Group", October 1972, pages 19.14b, 19.15b and 19.3 and in the "Deutsche Offenlegungsschrift" 2,037,190.8.

In said method the surface of the material to be shaped is provided with a circular grid. As the material is shaped by a semi-circular drawing die, the deformations are followed by the circular grid so that they can be measured. The circles change into ellipses of which the radially orientated long axis as well as their short axis perpendicular thereto are measured. In this way it is possible to obtain a picture of the distribution of the elongation in radial direction, wherein the deep-drawing agent is the variable factor and the other conditions are kept constant. A satisfactory deep-drawing agent will yield a more uniform distribution of the radial elongations, which finds expression in a lower maximum elongation.

The importance of the improvement obtained in the deep-drawing for the steel industry is illustrated in the following publications: Veerman et al. - "Sheet Formability Improvement by steel-mill applied lubricants", Economic Commision for Europe Steel Committee - January 1974 and "Estel Berichten", 1, 74, pages 46 to 52.

The deep-drawing properties of the agent of the invention which contains EMPOL 1022 as dicarboxylic acid, are compared in the following Table A with those of an agent of "Mineraloltechnik", 11/12, 1969, to which a carboxylic acid has been added. The mineral oil as mentioned in the tables has a viscosity of 20 c S at 50° C.

TABLE A

| No. | Composition % by weight | Percentage improvement (reduction) of the maximum radial elongation relative to that of 100% mineral oil. |
|---|---|---|
| 1 | 100 mineral oil | 0 |
| 2 | 99 mineral oil<br>1 oleic acid | 17.0 |
| 3 | 94 mineral oil<br>6 oleic acid | 22.8 |
| 4 | 75 mineral oil<br>25 oleic acid | 30.7 |
| 5 | 50 mineral oil<br>50 oleic acid | 32.7 |
| 6 | 99 mineral oil<br>1 Empol 1022<br>(dimeric acid) | 19.0 |
| 7 | 97 mineral oil<br>3 EMPOL 1022 | 28.1 |
| 8 | 94 mineral oil<br>6 Empol 1022 | 30.1 |
| 9 | 88 mineral oil<br>12 EMPOL 1022 | 31.1 |
| 10 | 75 mineral oil<br>25 EMPOL 1022 | 32.5 |
| 11 | 50 mineral oil<br>50 EMPOL 1022 | 34.0 |

Since in the method of the invention the di- and/or trimeric carboxylic acids to be used need not be directly soluble in the carrier medium their solubility may be improved by the addition of an auxiliary agent. Nonyl alcohol, lauryl alcohol or nonyl phenol may for example be used for this purpose. Preferably, nonyl alcohol is used. In principle, however, any substance may be used in which the carrier medium as well the dicarboxylic acid is soluble. From Table B it follows that said addition has no harmful influence of the deep-drawing properties of the agent. The results given in Table B were obtained with a trimeric carboxylic acid (EMPOL 1040). It was found that in cases whereafter 7200 seconds still no dewetting has been noticed, it will not occur.

TABLE B

| No. | Composition % by weight | Percentage improvement (reduction) of the maximum radial elongation relative to that of mineral oil with 5% nonyl alcohol |
|---|---|---|
| 12 | 95 mineral oil<br>5 nonyl alcohol | 0 |
| 13 | 99 composition 12<br>1 oleic acid | 13.0 |
| 14 | 99 composition 12<br>1 EMPOL 1040<br>(trimeric acid) | 13.4 |
| 15 | 97 composition 12<br>3 EMPOL 1040 | 21.0 |
| 16 | 94 composition 12<br>6 EMPOL 1040 | 22.1 |

TABLE B-continued

| No. | Composition % by weight | Percentage improvement (reduction) of the maximum radial elongation relative to that of mineral oil with 5% nonyl alcohol |
|---|---|---|
| 17 | 100 EMPOL 1040 | 29.8 |

As appears from the results of the above tables, the deep-drawing effect of the compositions of the invention is at least as satisfactory as that of a known agent in which a carboxylic acid has been incorporated.

The wetting effect of the agent of the invention was also compared with that of known agents in which a carboxylic acid had been incorporated.

The wetting was tested by pouring 1 drop of oil on a hard to wet steel plate of 10 × 15 cm, spreading said oil drop in the longitudinal direction of the plate using a small rubber roller with a light pressure.

The period of time between spreading the oil drop and the beginning of dewetting was taken as a criterion for the wetting by the oil.

The results are given in Table C. The agent of the invention contains 1 -50% by weight EMPOL 1022 as dicarboxylic acid.

TABLE C

| Composition of oil | Time until start of dewetting (in seconds) |
|---|---|
| 100% mineral oil | >7200 |
| 6% oleic acid +<br>94% mineral oil | 1500 |
| 13% oleic acid +<br>87% mineral oil | 120 |
| 26% oleic acid +<br>74% mineral oil | 60 |
| 60% oleic acid +<br>40% mineral oil | 10 |
| 100% oleic acid | 1 |
| 1% dicarboxylic acid<br>99% mineral oil | >7200 |
| 6% dicarboxylic acid<br>94% mineral oil | >7200 |
| 12% dicarboxylic acid<br>88% mineral oil | >7200 |
| 25% dicarboxylic acid<br>75% mineral oil | >7200 |
| 50% dicarboxylic acid<br>50% mineral oil | >7200 |

As appears from the above results, the wetting effect of the agent of the invention is much better than that of the known agents.

I claim:

1. An anyhydrous deep-drawing agent consisting essentially of a deep-drawing mineral oil having dissolved therein 1-50% by weight, based on the mineral oil, of dimeric carboxylic acids prepared by oligomerization of unsaturated fatty acids of 16-26 carbon atoms under pressure at a temperature of 180°-360° C. for about 3 to 10 hours.

2. A composition according to claim 1, wherein said mineral oil has a viscosity of 20-40 cS at 50° C.

3. A composition according to claim 2, wherein said unsaturated fatty acid is oleic acid, ricinoleic acid, linoleic acid or oleostearic acid.

4. A composition according to claim 3 containing about 1-15% by weight of said dimeric carboxylic acid.

5. A composition according to claim 3 further containing an auxiliary agent selected from the group consisting of nonyl alcohol, lauryl alcohol, and nonyl phenol in which both said acid and said mineral oil are soluble to improve the solubility of said acid in the mineral oil carrier.

* * * * *